United States Patent [19]

Welsh

[11] 4,089,327

[45] May 16, 1978

[54] KITCHEN EXHAUST SYSTEM

[75] Inventor: Clarke T. Welsh, Logansport, Ind.

[73] Assignee: Logansport Distributor Inc., Logansport, Ind.

[21] Appl. No.: 675,762

[22] Filed: Apr. 12, 1976

[51] Int. Cl.[2] ..... F24C 15/08; F23J 11/00

[52] U.S. Cl. ..... 126/299 D; 55/DIG. 36

[58] Field of Search ..... 98/115 R, 115 K, 115 LH; 126/299 R, 299 A, 299 C, 299 D; 55/DIG. 36

[56] References Cited

U.S. PATENT DOCUMENTS

| | | | |
|---|---|---|---|
| 2,577,150 | 12/1951 | Pledger | 126/299 B |
| 3,254,588 | 6/1966 | Truhan | 98/115 LH |
| 3,400,649 | 9/1968 | Jensen | 98/115 K |
| 3,408,914 | 11/1968 | Bayern | 98/115 LH |
| 3,457,850 | 7/1969 | Sweet et al. | 98/115 K |
| 3,645,194 | 2/1972 | Ahlrich | 98/115 K |
| 3,941,039 | 2/1976 | Kinney | 98/115 K |
| 3,978,777 | 9/1976 | Nett | 98/115 K |
| 3,980,072 | 9/1976 | Jacobs | 98/115 K |

*Primary Examiner*—Ronald C. Capossela

*Attorney, Agent, or Firm*—Woodard, Weikart, Emhardt & Naughton

[57] ABSTRACT

A kitchen exhaust system has an outside air supply blower and a hood exhaust blower discharging outside. 80% of the air discharged by the exhaust blower is taken from the intake blower through cooktop level and overhead supply outlets in the hood, and 20% is taken from the room. The supply discharge outlets are arranged to provide a venturi action removing smoke and fumes from over the cooktop.

9 Claims, 2 Drawing Figures

KITCHEN EXHAUST SYSTEM

BACKGROUND OF THE INVENTION

1. Field of the Invention

This invention relates generally to kitchen exhaust systems and more particularly to a system requiring comparatively little room air and thereby enabling significant conservation of energy.

2. Description of the Prior Art

For some years, the conventional practice in kitchen exhaust systems involved the use of a hood over the cooking surface to collect smoke and fumes and discharge it outside the building by use of a blower having an intake connected to the hood and an outlet connected to a discharge outside the building. Make-up air to the kitchen was provided from other parts of the building through doors, windows, or through air-handling equipment which required heating or cooling of the air, depending upon the outside temperature and the desired room temperature. The result was an excessive use of energy for heating or cooling the make-up air.

One subsequent development involved a second blower taking the air in directly from the outside and blowing it directly to the area under the hood. Sometimes this air was heated or cooled as was believed necessary to do so for comfort or other reasons. Some U.S. patents which I have noted and which disclose this or other approaches are as follows:

| Patent No. | Inventor | Issue Date |
|---|---|---|
| 2,810,337 | Samuelson et al | Oct. 22, 1957 |
| 3,173,980 | Hysinger | March 16, 1965 |
| 3,260,189 | Jensen | July 12, 1966 |
| 3,292,525 | Jensen | Dec. 20, 1966 |
| 3,386,365 | Jensen | June 4, 1968 |
| 3,411,428 | Ahlrich | Nov. 19, 1968 |
| 3,457,850 | Sweet et al | July 29, 1969 |
| 3,513,766 | Ahlrich | May 26, 1970 |
| 3,530,784 | Courchesne | Sept. 29, 1970 |
| 3, 566,585 | Voloshen et al | March 2, 1971 |
| 3,616,744 | Jensen | Nov. 2, 1971 |
| 3,800,689 | Brown | April 2, 1974 |
| 3,890,887 | Kaufman et al | June 24, 1975 |

Further improvement has been needed in kitchen exhaust systems, and the present invention is directed toward meeting the need.

SUMMARY OF THE INVENTION

Described briefly in a typical embodiment of the present invention, a kitchen exhaust hood is connected to a rooftop mounted exhaust blower and fresh air supply blower. The supply blower discharges air into the hood unit through which it is conducted to strategically located diffusers at the level of and to the rear of a cooktop, and above and slightly in front of the vertical projection of the cooktop so as to produce a venturi type action, with the capacity of the supply blower being slightly less than the capacity of the exhaust blower, whereby a small percentage of air is removed from the room while the rest is supplied from the outdoors without the need for tempering by heating in the winter or cooling in the summer.

DESCRIPTION OF THE PREFERRED EMBODIMENT

Figure 1:
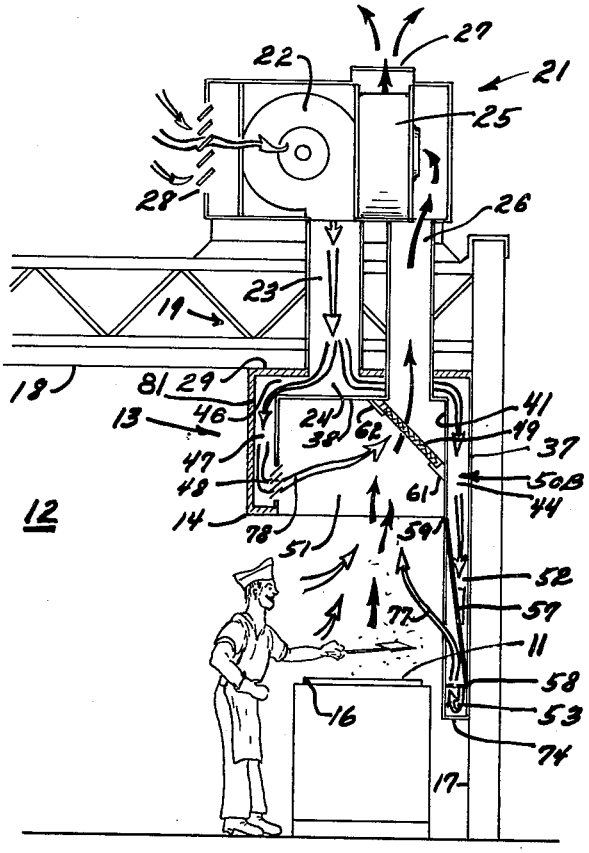
FIG. 1 is an elevational view of an installation according to a typical embodiment of the present invention.

Referring now to the drawings in details, the cooktop 11 located in kitchen 12 has a hood assembly 13 located above it. The lower front edge 14 of the hood is located from six to twelve inches in front of the upward projection of the upper front edge 16 of the cooktop. Accordingly it is six to twelve inches farther out from the wall 17 of the kitchen behind the cooktop.

The hood assembly is mounted at the ceiling 18 by hanging it from the ceiling and roof support structure 19, preferably using bolts threaded into nuts welded into the top of the hood.

A rooftop package 21 has a fresh-air supply blower discharging to hood plenum 24. An exhaust blower 25 in the rooftop package exhausts air from the conduit 26 out through the discharge opening 27. Louvers 28 admit air to the package housing and this air is filtered by filters behind the louvers so that the air entering the supply blower is comparatively free of dust, leaves, etc. The exhaust passage from conduit 26 through the exhaust blower to the exhaust discharge outlet 27 is completely sealed with respect to the interior of the package 21 so as to avoid any mixing of the intake fresh air and exhaust air.

Figure 2:
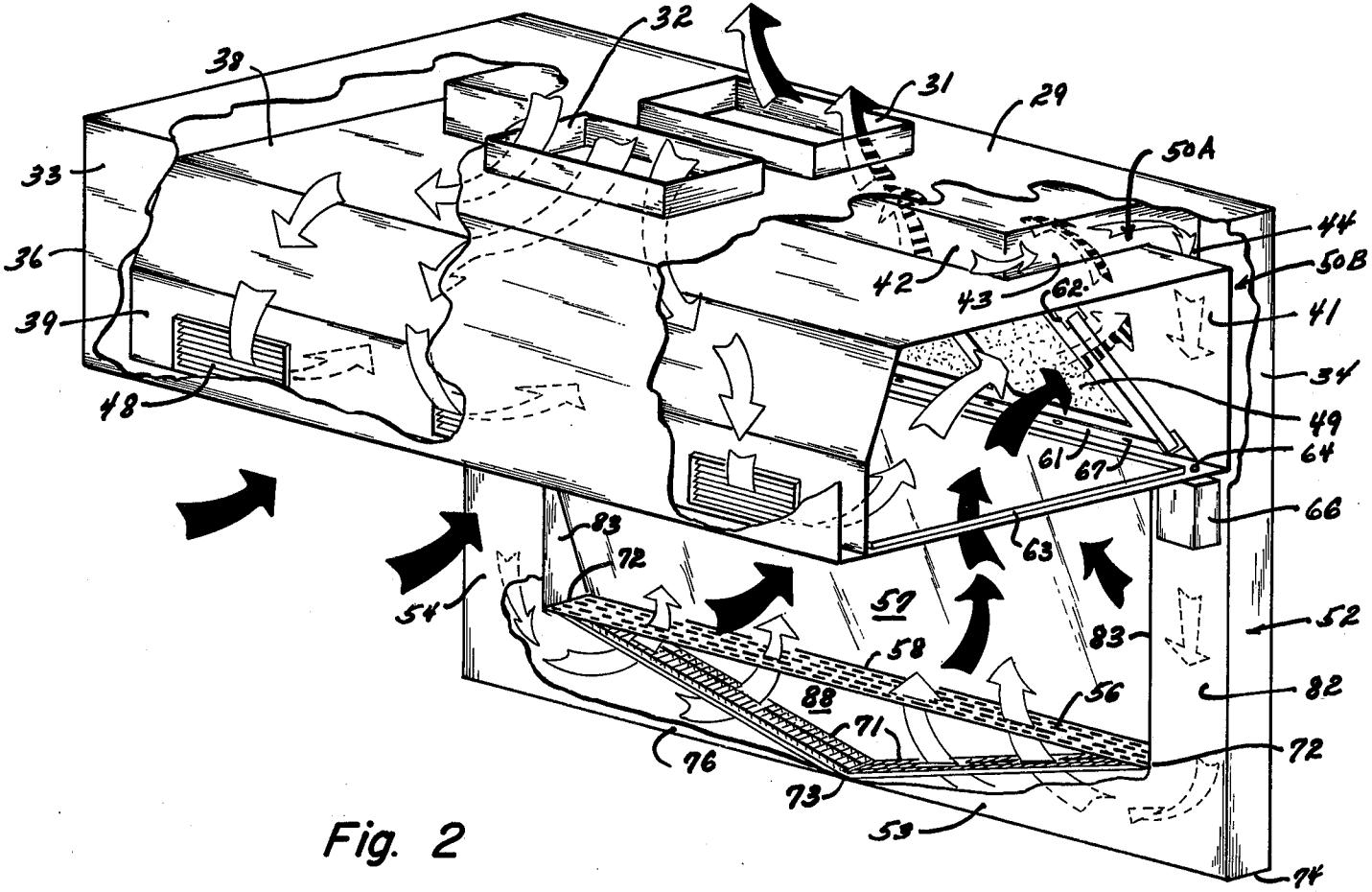
FIG. 2 is a perspective view of the hood assembly itself, with portions broken away to show interior details.

The specific structure of the hood assembly according to the typical embodiment of the present invention might be best understood by considering FIGS. 1 and 2 simultaneously. This assembly is made preferably of stainless steel, although other materials may also be used. The outer shell has a top 29 with an exhaust flange 31 and intake flange 32, these being connected respectively to the exhaust ducts 26 and supply ducts 23 of FIG. 1. The other margins of the upper plenum include the front wall 33, right side wall 34, left side wall 36, and rear wall 37. The side walls 34 and 36 are usually spaced so as to project beyond the vertical projection of the side edges of the cooktop by at least six to twelve inches on each side.

The inner margins of the upper plenum are defined by the inner top wall or roof 38, inner front wall 39, inner rear wall portions 41 at each side of the unit, the upper rear wall 42 (FIG. 2) and the upper inside right wall 43, and its counterpart at the left-hand side of the unit. Similarly a lower inside wall 44 is provided at each side. The result is that the plenum serves to feed fresh air forced downwardly by the blower 22 through the intake supply pipe 23 and intake flange 32 into the space 46 and down through the front supply plenum space 47 to the three register outlets 48 having vanes directed upwardly at an angle of 45 degrees toward the filters 49 between the smoke collector portion 51 of the hood, and the exhaust flange 31. Air is also supplied in this plenum from the passageway 50A of rectangular cross section which extends from the space between wall 43 and a corresponding portion of wall 34, rearwardly and downwardly to the space 50B between the rear outside wall 37 and rear inside wall 41 between the lower rear inside side wall 44 and the corresponding portion of the right side wall 34. This air is discharged downwardly into a passageway 52 supplying a lower plenum 53. A similar passageway 54 is provided to supply the plenum 53 from the left-hand side. A perforated metal screen 56 is provided in the top of this lower plenum, and an inclined backsplash 57 spans the space between the lower plenum supply ducts 52 and 54. The backsplash 57 extends upwardly and forwardly from line 58, toward the front of the hood to a point or line 59 immediately under the filter rack receiving the filters 49, the lower margin of the rack being shown at line 61 in FIG. 1. The filters slide down into this rack and the lower end is suppoted by the plate 61 while the upper end is supported by the flange 62 for each filter. A grease collector trough 63 is provided around the inner perimeter of the collector chamber 51 and has outlets 64 into grease collector cups 66. The holes 67 are provided at spaced points along the lower margin of the lower flange 61 of the filter rack to enable any grease which runs down the filters to run into the grease trough and run into the collector cups 66.

It is preferred that the lower plenum discharge outlet be at approximately the same level as the cooktop. It is also desired that it extend the full width of the cooktop. Flow splitter and director members 71 are provided in the lower plenum 53 extending downward from the side margins 72 of the outlet to the center 73 of the bottom 74 of the lower plenum. These are similar to the ice cube forming dividers in an ice tray, but are much longer, being typically 30 inches long from point 72 to point 73, six inches wide from the lower front wall 76 to the rear wall 88 of the lower plenum, and having ½ inch squares in them. These serve to provide uniform distribution of air flow up through the screen 56 from end to end of the unit.

As is best shown in FIG. 1, the air flow upward in the direction of arrow 77 from the lower plenum discharge outlet, and upward and rearwardly in the direction of arrows 78 from the upper plenum front discharge outlet registers 48, establishes a sort of venturi above the cooktop and below the filters 49, to efficiently draw smoke and fumes from the cooktop up through the filter 49 and out the exhaust.

As mentioned above, the exhaust system capacity is greater than the fresh air supply system capacity, and typically the difference is such that 80% of the air exhausted by blower 25 is received from the supply blower 22 whereas 20% is received from the kitchen. This 20% includes the smoke and fumes from the cooktop and may be supplied by the building ventilating system, opening up of doors, or otherwise. In addition to the fact that the apparatus is constructed to provide this difference in capacity between the exhaust system and the intake fresh air supply system for the unit, the size and arrangement of the duct work and registers of the upper and lower plenums is such that 50% of the fresh air supply is discharged through the registers 48, and 50% from the lower plenum through the screen 56. It should be understood that the screen 56 is not intended to perform a filtering function but only to keep food and foreign matter from falling into the lower plenum. The screen can be provided with handles for easy removal and cleaning if desired. The filters 49 are conventional washable filters such as manufactured by the Smith Filter Corporation of Moline, Ill., and can be readily removed from the filter rack and replaced after washing.

Since it is a significant feature of the invention that by using only 20% or less of the total air exhausted from a source other than the exhaust system, namely the kitchen, the heating or cooling equipment necessary for keeping the kitchen heated or cooled will use much less energy than was necessary heretofore when kitchen ventilating hoods derived all their air from the kitchen. Also, since the unit draws a large volume of fresh air from the outside, and that air can be quite cold in some climates in the winter, the outer wall of the plenum is insulated as shown at 81 typically with ¼ inch thick polyurethane foam adhered to the inner surface thereof.

The unit can be preferably constructed in lengths of 8 feet, 10 feet, and 12 feet, from wall 36 to wall 34. The vertical distance between the plenum top 29 and the inner upper wall or ceiling 38 is preferably four inches. The dimensions between front wall 33 and wall 39 is likewise preferably four inches. The dimension between the rear wall 37 and the front wall 82 of each of the lower plenum side feed branch conduits 52 and 54 is 6 inches, this being the front to rear width of the lower plenum and discharge screen 56. The width between the outside side wall and inside side wall 34 and 83 of the conduit 52, and corresponding walls of conduit 54, is one foot. The height of the lower plenum is 13 inches and the vertical distance from the lower edge 14 of the hood and the bottom wall 74 of the lower plenum is 51 inches. The height from edge 14 to the top 29 of the upper plenum is 33 inches. The overall distance from the rear wall 37 to the front wall 33 of the upper plenum is 54 inches.

Because of the large supply of fresh air to the hood from the outside, in addition to minimizing the use of room air, it also rapidly cools fumes from the cooking surface to maintain comparatively low temperatures in the hood, significantly reducing the possibility of grease fires, and making the filters more efficient for grease removal. The vertical flow of make-up air from the lower plenum which, together with the conduits 52 and 54 is sometimes referred to as a breech, forms an air screen over the front surface of the backsplash sheet 57 retarding any grease build-up on it, and thus preventing any attractive appearance features which may be provided thereon, such as a diamond or check pattern which can be produced in a press brake.

The invention claimed is:

1. A kitchen exhaust system comprising:

a hood for disposition above a cooking top;

a first blower for taking air from outside a building and discharging it into said hood;

a second blower for taking air and fumes from inside said hood for discharge outside a building;

a lower plenum located below the hood and connected to said first blower for discharging outside air upward into the interior of said hood;

an exhaust outlet from said hood and connected to said second blower;

air outlet means in said hood coupled to said first blower including flow-directing means for discharging air from said first blower across the interior of said hood toward said exhaust outlet;

said air outlet means in said hood include registers horizontally spaced along an inner front wall of the hood near the bottom of the hood and having vanes inclined upward toward the rear of the hood to direct fresh air upwardly and rearwardly from the lower front to the upper rear of the interior of the hood;

said hood includes an upper plenum coupled to said first blower and receiving fresh air therefrom;

at least one fresh air conduit is connected to said upper plenum to receive fresh air from said fist blower and conduct it downwardly to said lower plenum; and a second fresh air conduit horizontally spaced from said first conduit and generally parallel thereto and connected to said upper and lower plenums, said lower plenum being a horizontally extending tube having its opposite ends connected to said conduits; said conduits discharging fresh air into said opposite ends whereby air flow is toward the middle of said lower plenum.

2. The apparatus of claim 1 wherein:

said lower plenum has a top opening throughout its length for upward discharge of air therefrom.

3. The apparatus of claim 2 and further comprising:

a generally planar back plate extending between said conduits and upward and forward from the rear margin of said top opening forward to a line at front margins of said conduits at said hood, to continuously direct air discharged upwardly from said lower plenum in a slightly forward direction to cooperate with air directed upwardly and rearwardly from said register to create a venturi action to move room air from above a cooking top under the hood upward into the interior of said hood.

4. The apparatus of claim 3 wherein:

a cooktop is located under said hood; and the cooktop and the top opening of said lower plenum are at substantially the same level.

5. The apparatus of claim 3 and further comprising:

a pair of air flow splitters in said lower plenum extending from the upper outer ends of said top opening downward and inward to the bottom center of the lower plenum and having a plurality of vanes therein, the vanes being configured such that air flowing from the lower ends of said conduits toward the center of said lower plenum is split and directed vertically upward throughout the length of said opening thereby producing a uniform upward flow of air across the length of said opening to minimize areas of reduced flow or lower pressure caused by increased air turbulence.

6. The apparatus of claim 3 and further comprising:

filter means in the rear of said hood between the interior and the exhaust outlet for filtering air and fumes pulled by said second blower from the hood for discharge outside the building;

thermal insulating sheet material lining the inside face of outer top and front walls of said hood for preventing radiant cooling of the room air while allowing cooling of hot cooking fumes in said hood thereby reducing the possibility of grease fires and increasing the efficiency of said filter means for grease removal.

7. A kitchen exhaust air duct apparatus comprising:

a first air conduit having an upper inlet for connection to an air supply from a blower;

a second conduit horizontally spaced from said first conduit and generally parallel thereto and having an upper inlet for connection to an air supply from a blower;

a horizontally extending tube having its opposite ends connected to lower outlet ends of said conduits whereby said conduits can discharge air into said opposite ends whereby air flow is toward the middle of said lower plenum;

and a hood having a fresh air plenum therein connected to said inlets for supplying air to said inlets from said blower;

said tube has a top opening throughout its length for upward discharge of air therefrom; and a generally planar back plate extending between said conduits and upward and forward from the rear margin of said top opening forward to a line adjacent front margins of said conduits at said inlets, to continuously direct air discharged upwardly from said tube in a slightly forward direction.

8. A kitchen exhaust air duct apparatus comprising:

a first air conduit having an upper inlet for connection to an air supply from a blower;

a second conduit horizontally spaced from said first conduit and generally parallel thereto and having an upper inlet for connection to an air supply from a blower;

a horizontally extending tube having its opposite ends connected to lower outlet ends of said conduits whereby said conduits can discharge air into said opposite ends whereby air flow is toward the middle of said lower plenum, said tube having a top opening throughout its length for upward discharge of air therefrom; and a pair of air flow splitters in said tube extending from the upper outer ends of said top opening downward and inward to the bottom center of the tube and having a plurality of vanes therein, the vanes being configured such that air flowing from the lower ends of said conduits toward the center of said tube is split and directed vertically upward throughout the length of said opening thereby producing a uniform upward flow of air across the length of said opening to minimize areas of reduced flow or lower pressure caused by increased air turbulence.

9. The apparatus of claim 8 and further comprising:

a hood having a fresh air plenum therein connected to said inlets, and a fume collecting interior above and forward of said top opening.

* * * * *